US005813270A

United States Patent [19]

Carter

[11] Patent Number: 5,813,270

[45] Date of Patent: Sep. 29, 1998

[54] CONTINUOUS EXTRUSION APPARATUS

[75] Inventor: Edward Purvis Carter, Gillingham, England

[73] Assignee: BWE Limited, Ashford, England

[21] Appl. No.: 737,639

[22] PCT Filed: Mar. 15, 1996

[86] PCT No.: PCT/GB96/00648

§ 371 Date: Nov. 18, 1996

§ 102(e) Date: Nov. 18, 1996

[87] PCT Pub. No.: WO96/29162

PCT Pub. Date: Sep. 26, 1996

[30] Foreign Application Priority Data

Mar. 17, 1995 [GB] United Kingdom ..... 9505380

[51] Int. Cl.[6] ..... B21C 23/00

[52] U.S. Cl. ..... 72/262; 72/264

[58] Field of Search ..... 72/262, 264, 269, 72/271

[56] References Cited

U.S. PATENT DOCUMENTS

| | | | |
|---|---|---|---|
| 4,362,485 | 12/1982 | Slater et al. | 72/262 |
| 4,564,347 | 1/1986 | Vaughan | 72/262 |

FOREIGN PATENT DOCUMENTS

| | | | |
|---|---|---|---|
| 0125788 | 11/1984 | European Pat. Off. | 72/262 |
| 2103527 | 2/1983 | United Kingdom | 72/262 |
| WO 83/00452 | 2/1983 | WIPO | 72/262 |

*Primary Examiner*—Joseph J. Hail, III
*Assistant Examiner*—Ed Tolan
*Attorney, Agent, or Firm*—Shlesinger, Arkwright & Garvey LLP

[57] ABSTRACT

A die top assembly engaging with a rotating wheel (not shown) of a continuous extrusion apparatus includes a die top (22) formed with a part cylindrical face (34) coacting with the wheel cylindrical surface and is positioned in a shoe held in contact with the wheel. The die top (22), which is required to resist the very high extrusion pressure forces, is carried on a support block (30) and, at the face remote from the part cylindrical face (34), is formed with a recess (50) accommodating a die support ring (54) and spacer (52). Ports (28) registering with circumferential grooves in the rotating wheel extend from the part cylindrical face (34) to a semitoroidal channel (44) and extrudate supply chamber (46) extending around a central boss (80). A central mandrel die piece (72) is secured in position by means of a bolt (76) threaded into a blind bore (78) in the boss (80) and coacts with a cylindrical die (56) to form an extrusion orifice (86). By securing the die piece (72) by means of the bolt (76) threaded into the blind bore (78), the dimension radially of the die top (22) may be reduced to a minimum by virtue of avoidance of weakening penetrations other than the ports (28) in the portion of the die top (22) adjoining the rotating wheel. This has the benefit that the axial extent of the ports (28) may be reduced to a minimum, thereby reducing to a minimum the frictional losses imposed on feed material extruded through the ports, an important consideration particularly when extruding copper.

4 Claims, 3 Drawing Sheets

CONTINUOUS EXTRUSION APPARATUS

This invention relates to apparatus for the forming of metals by a continuous extrusion process in which feedstock is introduced into a circumferential groove in a rotating wheel to pass into a passageway formed between the groove and arcuate tooling extending into the groove.

EP-A-071 490 discloses continuous extrusion apparatus having a rotatable wheel formed with a circumferential groove, arcuate tooling bounding a radially outer portion of the groove provided with an exit aperture in a die top and an abutment displaced in the direction of rotation from the exit aperture.

According to the present invention the die top is formed with a part cylindrical face arranged to co-act with a portion of the cylindrical surface of the rotatable wheel and, remote from the part cylindrical face, a face having a central recess, extrusion mandrel die means are positioned in the recess with an extrudate supply chamber formed in the recess discharging directly to the extrusion mandrel die means with port means connecting the extrudate supply chamber to the circumferential groove in the rotatable wheel and an extrusion mandrel die piece is positioned centrally of the recess on a bolt threaded into the die top from the recess.

Preferably, a boss is positioned centrally of the recess to receive the bolt and is formed with a frusto-conical seating co-acting with a corresponding face on the mandrel die piece to seat and centrally locate the mandrel die piece on the boss.

Desirably, a die support ring carrying a cylindrical die is positioned in the recess co-axially of the mandrel die piece to provide an extrusion orifice intermediate the cylindrical die and the mandrel die piece.

Suitably, downstream of a surface portion bounding the extrusion orifice, the cylindrical die and the die support ring are formed with an outwardly diverging surface portion.

Advantageously, the rotatable wheel is formed with a plurality of circumferential grooves. Where an even number of circumferential grooves is provided the recess may be positioned with a central axis intermediate the circumferential grooves.

Thin-walled copper tubing may be produced using a copper feed stock and an annular extrusion orifice.

The invention will now be described, by way of example, with reference to the accompanying, partly diagrammatic drawings, in which.

Figure 1:
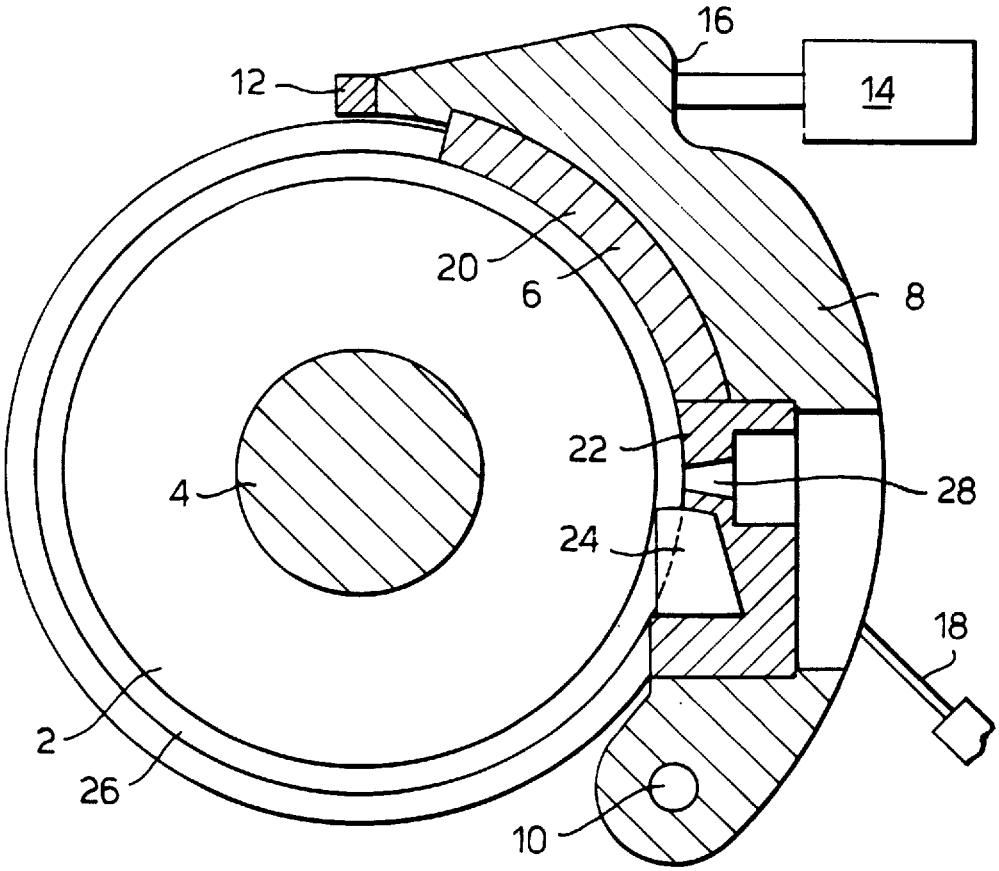
FIG. 1 is a cross-sectional side elevation of the continuous extrusion apparatus partly offset from a plane through one groove of a pair of grooves in a wheel to a plane extending centrally of the pair of grooves through an extrusion die, the offset section plane following the centre line of an exit aperture connecting the respective groove to the extrusion die.
Figure 2:
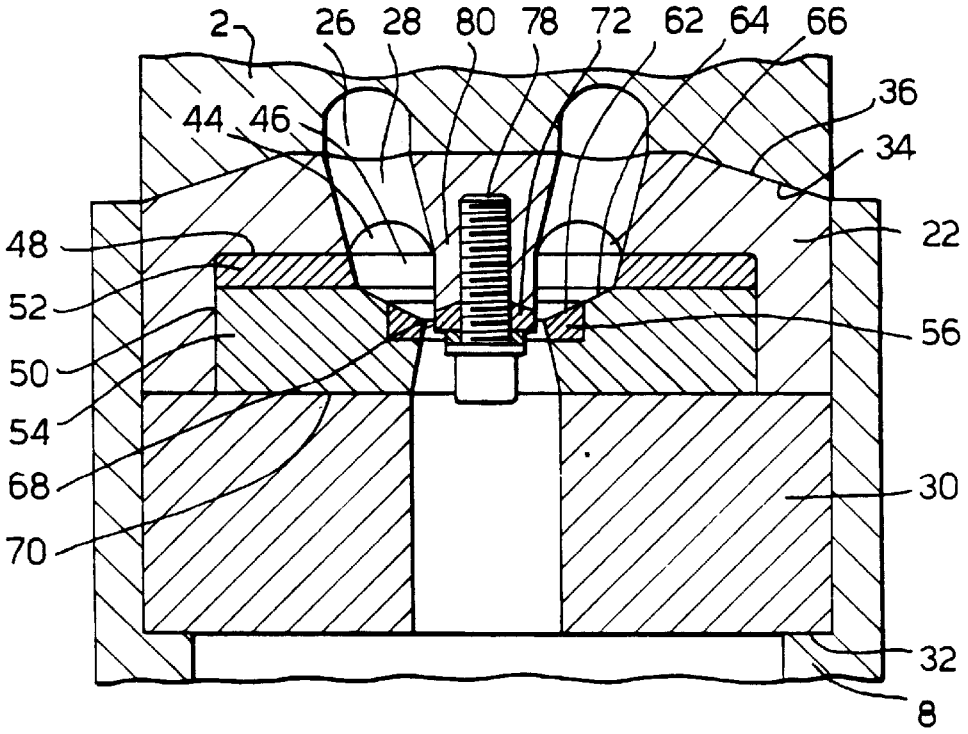
FIG. 2 is a cross-sectional view, taken in plan, of a portion of the wheel and associated parts, along the plane indicated by the line II—II in FIG. 1 and FIG. 3.
Figure 3:
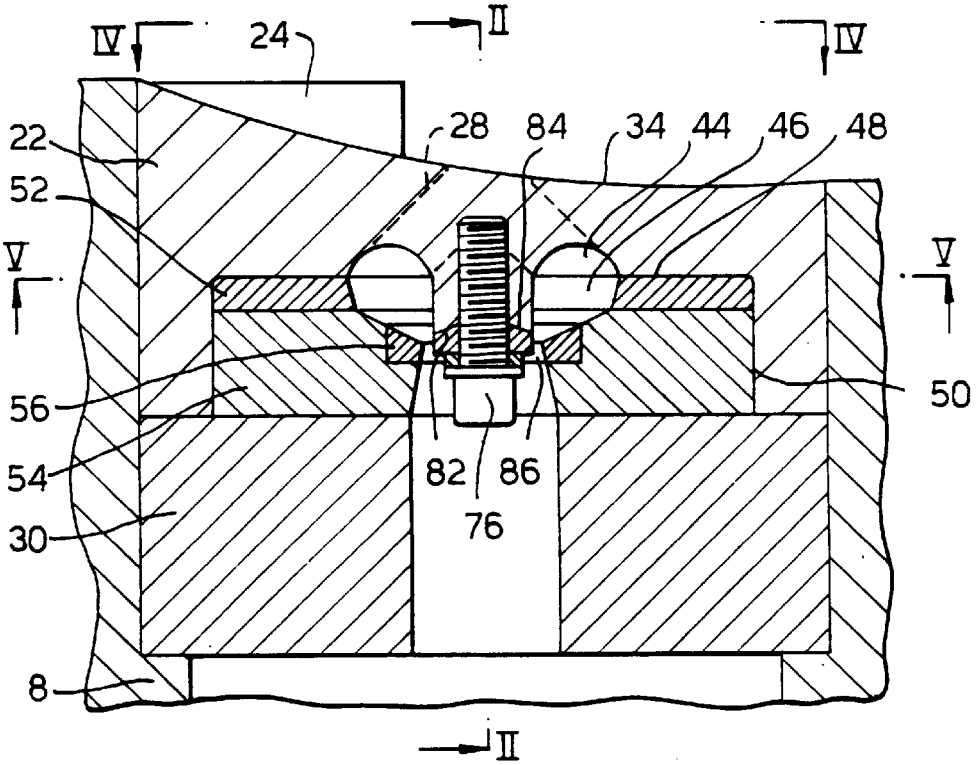
FIG. 3 is a cross-sectional side elevation of parts associated with the extrusion die.
Figure 4:
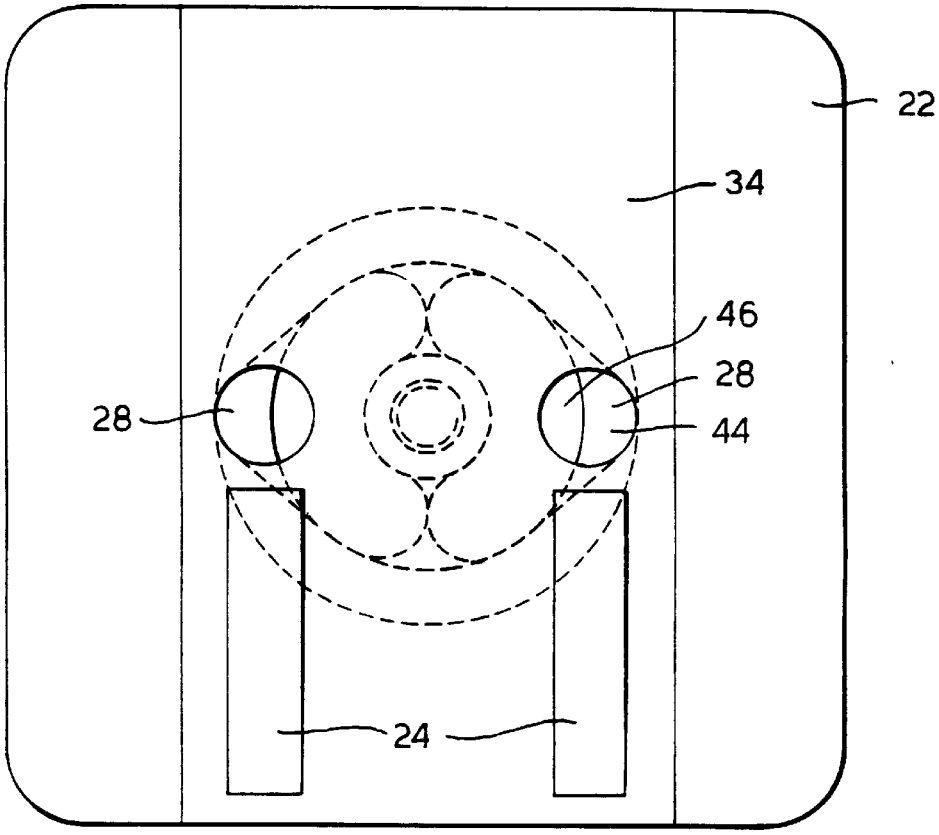
FIG. 4 is a plan view of a die top portion.
Figure 5:
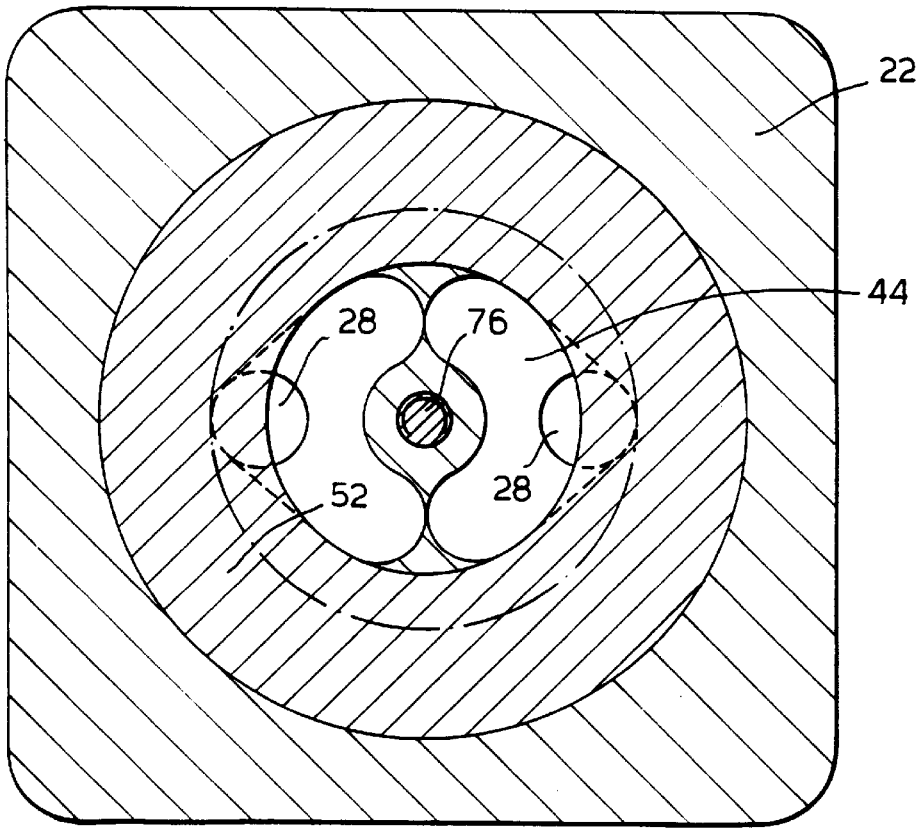
FIG. 5 is a view of the die top portion taken from below.

As shown in FIG. 1 the continuous extrusion apparatus includes a circumferentially grooved wheel 2 mounted on a horizontal drive shaft 4 running on bearings (not shown) positioned on a bed (not shown). Arcuate tooling 6 is positioned in a shoe 8 mounted on a pivot 10 extending parallel to the horizontal drive shaft 4 and urged against a stop 12 positioned adjacent the wheel 2 and above the drive shaft 4 by means of a main hydraulic ram 14 bearing against a shoulder 16 formed on the shoe. A support ram 18 is provided to pivot the shoe 8 into, or out of, registration with the wheel 2. The tooling 6 includes a shoe insert 20, a die top 22 and abutments 24 positioned in the shoe 8 to register with the wheel. The wheel 2 is formed with circumferential twin grooves 26 and the shoe insert 20 serves, when the shoe is in position adjacent the stop 12, to form a closure to the adjacent portion of the circumferential grooves 26 in the wheel as the wheel rotates past the shoe insert. The die top 22 forms a continuation of the shoe insert 20 and also forms a closure to the adjacent rotated portion of the circumferential grooves. The abutments 24 extend into the respective circumferential grooves 26 to form an obturation of the grooves and cause displacement of feed material in the grooves through respective exit apertures or ports 28 to discharge to a die adapted to produce a required tubular extrusion product.

As indicated to an enlarged scale in FIGS. 2,3,4 and 5, the die top 22 is attached to a support block 30 by bolts (not shown) and positioned in a stepped seating 32 in the shoe 8. A face 34 of the die top 22 remote from the support block 30 conforms to the twin grooved surface 36 of the wheel 2 and is of generally rectangular cross-section. The ports 28 extend from locations in the face 34 registering with the twin grooves 26 in the wheel 2 to a semi-toroidal channel 44 in an end face 48 of a central cylindrical recess 50 formed in the die top 22 adjacent the support block 30. The ports 28 are formed with a cross-section increasing toward the channel 44. A complementary extrudate supply chamber 46 is formed in a spacer 52 and in a die support ring 54 carrying a cylindrical die 56 positioned in the recess 50 co-axially of a central mandrel die piece 72. The die support ring 54 and the cylindrical die 56 co-act to form an annular extrusion orifice 86 and are provided with contiguous frusto-conical faces 62, 64 converging smoothly from the semi-toroidal channel outer periphery 66 to the cylindrical die circumferential edge 68. The cylindrical die 56 and die support ring 54 are flared outwardly from the circumferential edge 68 to an end face 70 of the die support ring seating on the support block 30.

The central mandrel die piece 72 and a spacer 74 are secured to the die top 22 by means of a bolt 76 threaded in to a blind bore 78 in a boss 80 co-axial of the semi-toroidal channel 44 tangentially continuous with a radially inner portion thereof. The die piece 72 is formed with a frusto-conical end face 82 (FIG. 3) arranged to mate with a corresponding seating 84 on the boss 80 rigidly to locate the die piece on the boss. Since the die piece 72 is secured to the die top 22 by means of the bolt 76 threaded into the blind bore 78 from the face of the die top remote from the face 34 registering with the wheel 2, the dimension radially of the wheel of the die top 22 may be reduced to a minimum by virtue of avoidance of weakening penetrations other than the ports 28. This has the result that the axial extent of the ports 28 is reduced to a minimum, thereby reducing to a minimum frictional losses imposed on feed material extruded through the ports. The axes of the ports are aligned to minimise the distance between the grooves 26 and the extrusion orifice 86. Thus, in other embodiments, the axes of the ports may diverge from the central plane of the wheel 2.

Within the dimensional confines imposed by the outer diameter of the semi-toroidal channel 44 a range of cylindrical dies 56 and central mandrel die pieces 72 may be utilised without having to utilise a different die top 22, thereby increasing the versatility of the apparatus without incurring large additional expenditure for a complete set of tooling.

Whilst it is intended that the hereinbefore described continuous extrusion apparatus has particular relevance to the production of thin-walled copper tube, it will be appreciated that other materials or cross-sections may be extruded with similar advantages.

In a situation in which the wheel 2 is provided with a single circumferential groove or an uneven number of circumferential grooves, the port 28 leading from the single groove or the central groove may be bifurcated to extend past the bore 78 for the bolt 76.

I claim:

1. A continuous extrusion apparatus, comprising:

a) a rotatable wheel having a circumferential groove and a cylindrical surface;

b) an arcuate tooling bounding a radially outer portion of said groove;

c) said tooling having a die top with an exit aperture, a part cylindrical face being arranged to co-act with a portion of said cylindrical surface, and an end face remote from said part cylindrical face and having a central recess with an extrudate supply chamber, said exit aperature connecting said extrudate supply chamber to said circumferential groove;

d) said tooling having a central extrusion mandrel die being positioned centrally in said recess and being removably secured to said die top with a bolt;

e) said tooling having a die support ring carrying a cylindrical extrusion mandrel die being disposed within said recess and co-axially aligned with said central extrusion mandrel die providing an extrusion orifice therebetween;

f) said die support ring and said cylindrical extrusion mandrel die having frusto-conical surface portions converging to said extrusion orifice; and, g) said tooling having an abutment being disposed to extend into said groove to displace a feed material in said groove through said exit aperature to said extrudate supply chamber and said extrusion orifice.

2. A continuous extrusion apparatus, as recited in claim 1, wherein:

a) said central extrusion mandrel die has a frusto-conical face; and, b) said tooling has a boss centrally disposed within said recess and operatively adapted to receive said bolt, and a frusto-conical seating face operatively adapted to cooperate with said frusto-conical face of said central extrusion mandrel die.

3. A continuous extrusion apparatus, as recited in claim 1, wherein:

a) said rotatable wheel has a plurality of circumferential grooves.

4. A continuous extrusion apparatus, as recited in claim 1, wherein:

a) said rotatable wheel has an even number of circumferential grooves; and, b) said recess is disposed with a central axis intermediate of said even number of circumferential grooves.

* * * * *